US010543885B2

(12) United States Patent
Pereira

(10) Patent No.: US 10,543,885 B2
(45) Date of Patent: Jan. 28, 2020

(54) MULTI AXIS SUSPENSION VESSEL

(71) Applicant: Fred Pereira, Las Vegas, NV (US)

(72) Inventor: Fred Pereira, Las Vegas, NV (US)

( * ) Notice: Subject to any disclaimer, the term of this patent is extended or adjusted under 35 U.S.C. 154(b) by 16 days.

(21) Appl. No.: 15/839,809

(22) Filed: Dec. 12, 2017

(65) Prior Publication Data

US 2018/0162495 A1 Jun. 14, 2018

Related U.S. Application Data

(60) Provisional application No. 62/433,419, filed on Dec. 13, 2016.

(51) Int. Cl.

| | |
|---|---|
| ***B63B 1/14*** | (2006.01) |
| ***B63B 3/48*** | (2006.01) |
| ***B63B 17/00*** | (2006.01) |
| ***B63B 39/00*** | (2006.01) |
| *B63B 35/00* | (2006.01) |

(52) U.S. Cl.

CPC ..... *B63B 1/14* (2013.01); *B63B 3/48* (2013.01); *B63B 39/005* (2013.01); *B63B 17/0081* (2013.01); *B63B 2001/145* (2013.01); *B63B 2003/485* (2013.01); *B63B 2035/004* (2013.01)

(58) Field of Classification Search

CPC .... B63B 1/14; B63B 3/00; B63B 3/48; B63B 35/00; B63B 17/00; B63B 17/0081; B63B 29/00; B63B 29/02

USPC ..... 114/71, 363

See application file for complete search history.

(56) References Cited

U.S. PATENT DOCUMENTS

| | | | | |
|---|---|---|---|---|
| 3,389,673 | A * | 6/1968 | Cuesta | B63B 17/0081 114/71 |
| 5,207,408 | A * | 5/1993 | Burg | B63B 29/02 114/284 |
| 6,786,172 | B1 * | 9/2004 | Loffler | B63B 17/0081 114/363 |
| 7,434,525 | B2 * | 10/2008 | Hodge | B63B 39/005 114/71 |
| 8,261,684 | B2 * | 9/2012 | Werner | B63B 17/0081 114/363 |
| 2008/0282954 | A1 * | 11/2008 | Reason | B63B 17/0081 114/71 |

* cited by examiner

*Primary Examiner* — Lars A Olson

(74) *Attorney, Agent, or Firm* — Dale Jensen, PLC; Dale Jensen

(57) ABSTRACT

A vessel with three platforms—an outer hull, an inner deck hull and a passenger carriage, having four independent suspension systems there between so as to accommodate for the multi axis movements of the outer hull. This multi axis suspension system spread between the three platforms will offer the passenger carriage stability against the pitch, yaw and roll rotations a vessel makes as it twists and turns going up and down the slope of a wave as well as the heave, sway and surge movements induced by the waves pushing the vessel around and or the ship sliding down the face of a wave.

9 Claims, 12 Drawing Sheets

2-A

MULTI AXIS SUSPENSION VESSEL

PRIORITY

This application incorporates in its entirety and claims domestic priority to U.S. Provisional Application 62/433,419 filed Dec. 13, 2016 and entitled "Multi Axis Suspension Vessel."

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to watercraft, and more particularly to a boat with multi axis suspension system technology.

BACKGROUND

Smaller vessels are much more prone to jostling as a response to the water and wind conditions then are larger vessels with hulls long enough to span multiple waves. In these smaller vessels, docking and beach landings are more difficult and downright dangerous when the seas are boiling. For those with leg, back or necks problems, rough water can exacerbate their discomfort. Military or scientific landing craft and vessels laden with expensive equipment are at the mercy of the weather and sea conditions for their landings and operation.

The prior art vessel stabilizations attempt to put a suspension interface between the mass of the passengers and the vessel, similar to those utilized in transport trucks. While this has had limited success, it has only had this success with smaller craft used in mildly turmoil lakes and rivers. Unfortunately, to date there have been no hull designs or active stabilization or suspension systems that can effectively mitigate the pitch, roll and yaw (also denoted as sway, surge and heave) that a vessel experiences in extremely rough weather.

There is a long felt need in the marine industry for a smaller vessel that can stabilize its passengers and cargo against the rapid multi axial movements of a vessel in rough seas. Such a solution is provided by the embodiment set forth below.

BRIEF SUMMARY

In accordance with various embodiments, a vessel with a multi axis suspension system is provided.

In one aspect, a vessel with four separate and distinct suspension systems is provided, that in unison act to stabilize a passenger carriage which is supported from an inner deck hull which is in turn supported from an outer hull.

In another aspect, a vessel suspension system designed to be operated in a configuration where the vessel's outer hull is as light as possible and the majority of the vessel's mass (including the gas tank, engines, passengers and cargo) resides on the part of the vessel intended to be stationary, the inner deck hull.

In yet another aspect, a vessel with an outer hull, an inner deck hull and a passenger carriage, having four independent suspension systems there between so as to accommodate for multi axis movements of the outer hull.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. No single feature or features should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "vessel" refers to all sizes of watercraft including boats, ships and vessels.

The present invention relates to a novel design for a twin hull vessel having a multi axis suspension system operably disposed in four separate suspension systems as follows: vertically between an inner deck hull having a first mass and an outer hull having a second, lesser mass, horizontally between the inner deck hull and the outer hull, angular vertically between the inner deck hull and the outer hull, and angular vertically between the inner deck hull and the passenger carriage. The synergistic effect of having a tri platform vessel with the above suspension systems enables new level of shock absorption in multiple axis of movement.

Figure 10:
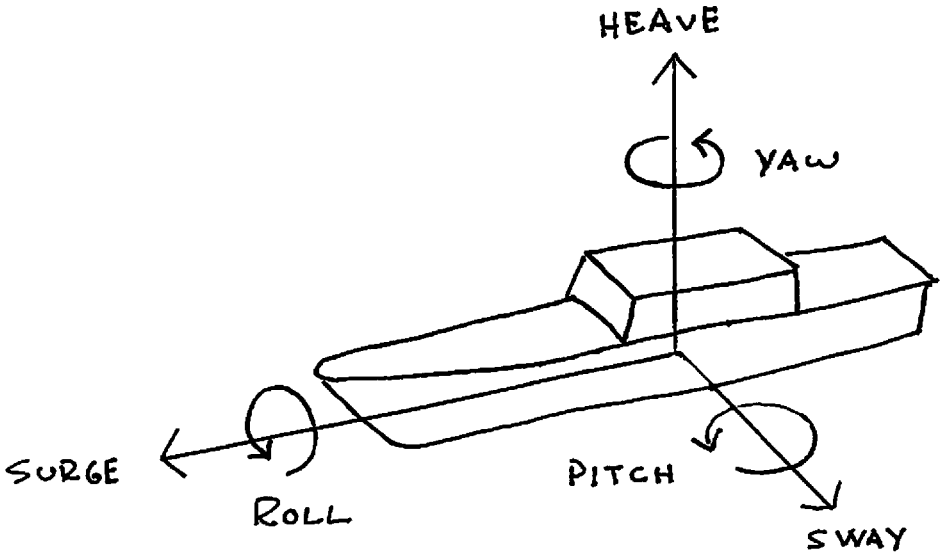
FIG. 10 is a perspective view of the pitch, yaw and roll rotations of a vessel.

In the way of background, a vessel at sea experiences movement in six directions as depicted by FIG. 10. Pitch, yaw and roll are rotations a vessel makes as it twists and turns going up and down the slope of a wave. Heave, sway and surge are movements induced by the waves pushing the vessel around and/or the ship sliding down the face of a wave. Simply stated, a vessel in rough water must be able to compensate for movement in any or all of the three axis, alone or in any combination. The only way this type of suspension can work is if the vessel is a three tiered vessel that has one outer hull grounded in the water, one inner deck hull spaced within the outer hull, and a passenger carriage suspended off the inner deck hull, with the multi axis four suspension system operative located there between these various three tiers.

Figure 1:
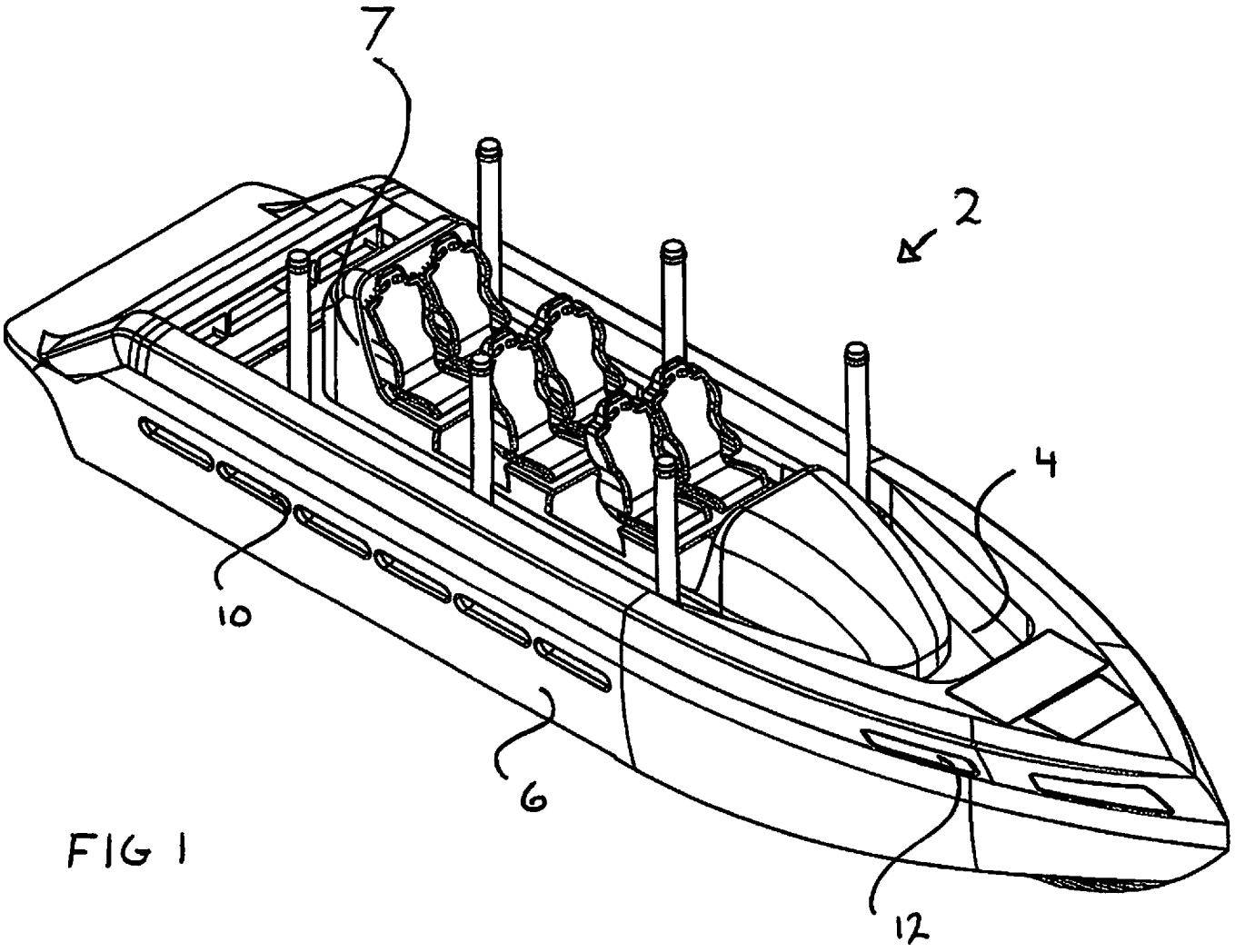
FIG. 1 is a left side perspective view of the multi axis suspension vessel.
Figure 3:
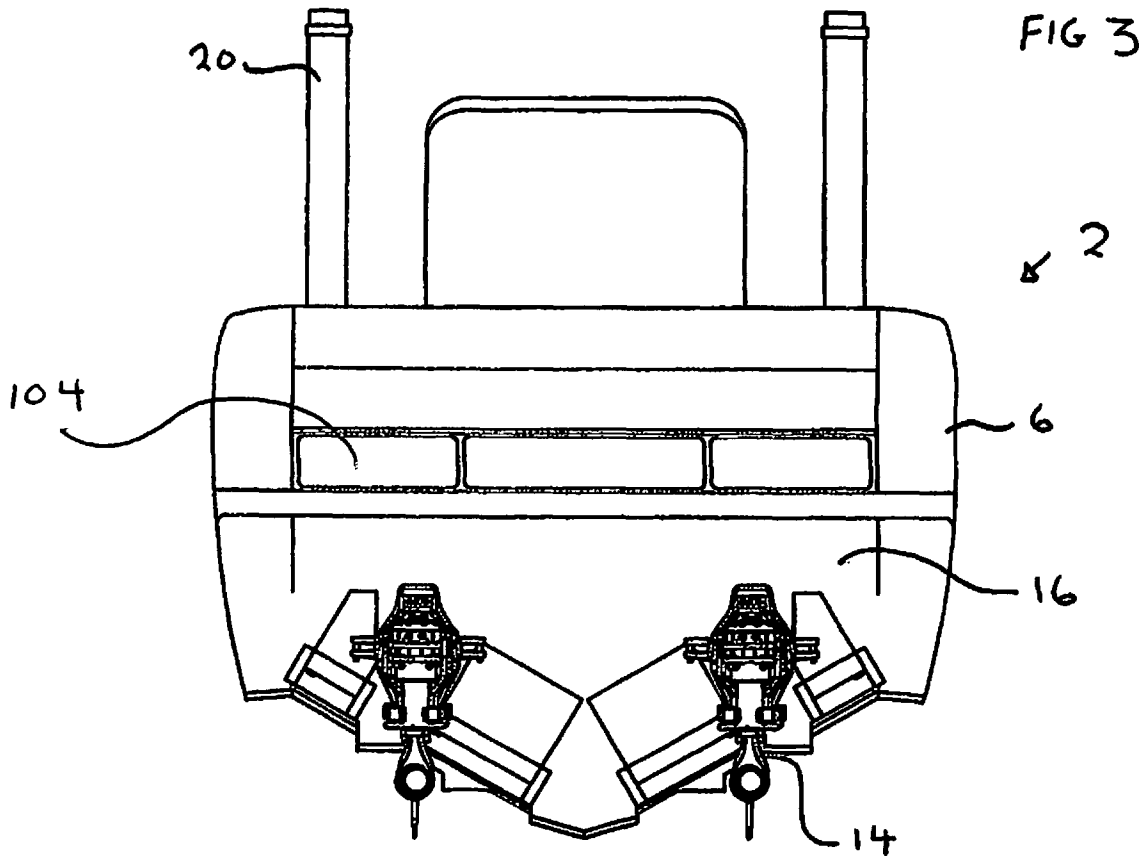
FIG. 3 is a rear view of the multi axis suspension vessel.
Figure 4:
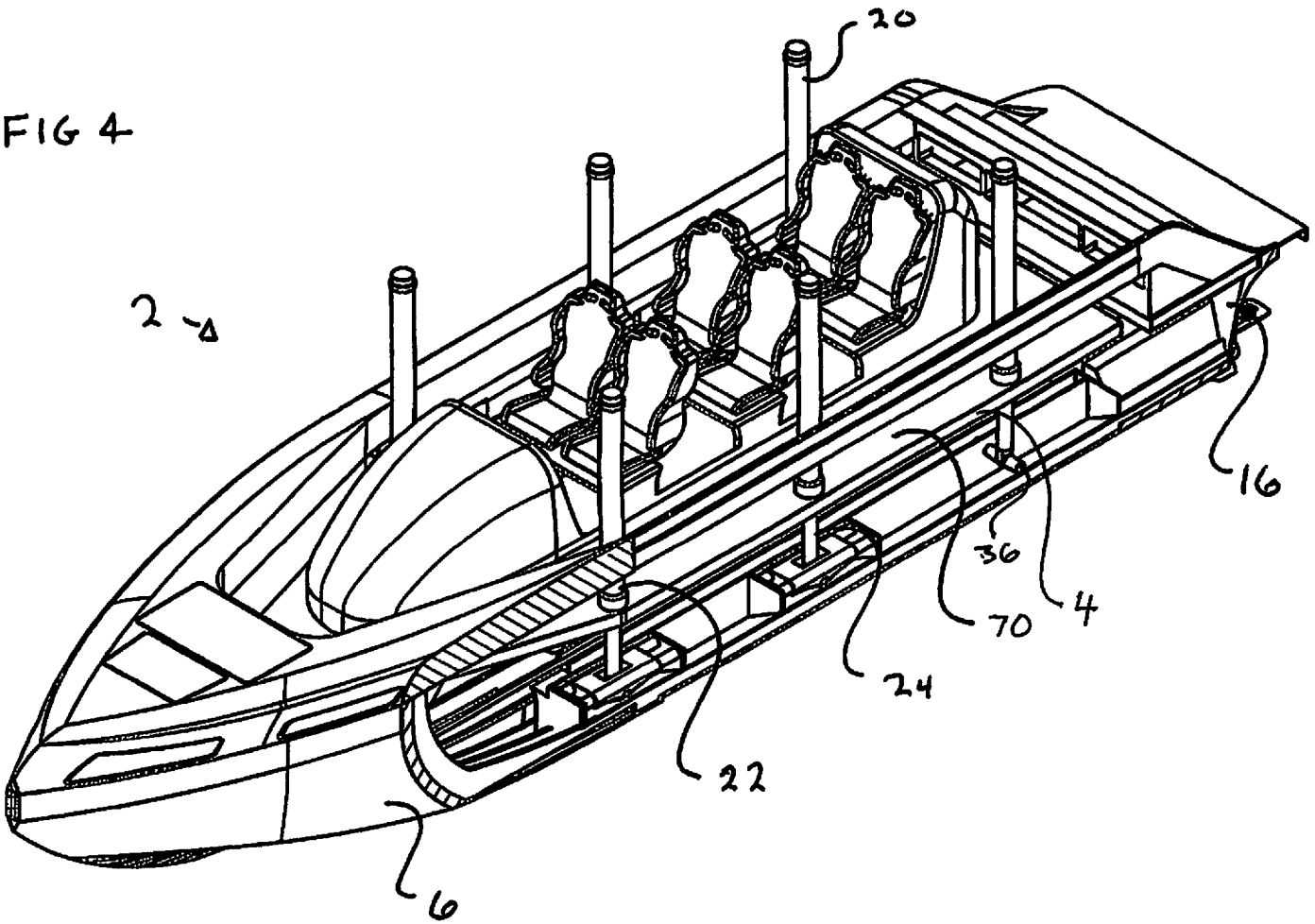
FIG. 4 is a right side perspective view of the multi axis suspension vessel, with a side cutaway.

Looking at FIGS. 1, 3, 4 an 11 it can be seen that the vessel 2 has a passenger carriage 7 suspended off an inner deck 4, which is nestled in a suspended, spaced configuration in an outer hull 6. The relative spacing and nestled arrangement is maintained by the four suspension systems. Optimally, the vessel 2 is made of a combination of carbon fiber and fiberglass bolted and glued together, with metal structural members imbedded therein.

Figure 2:
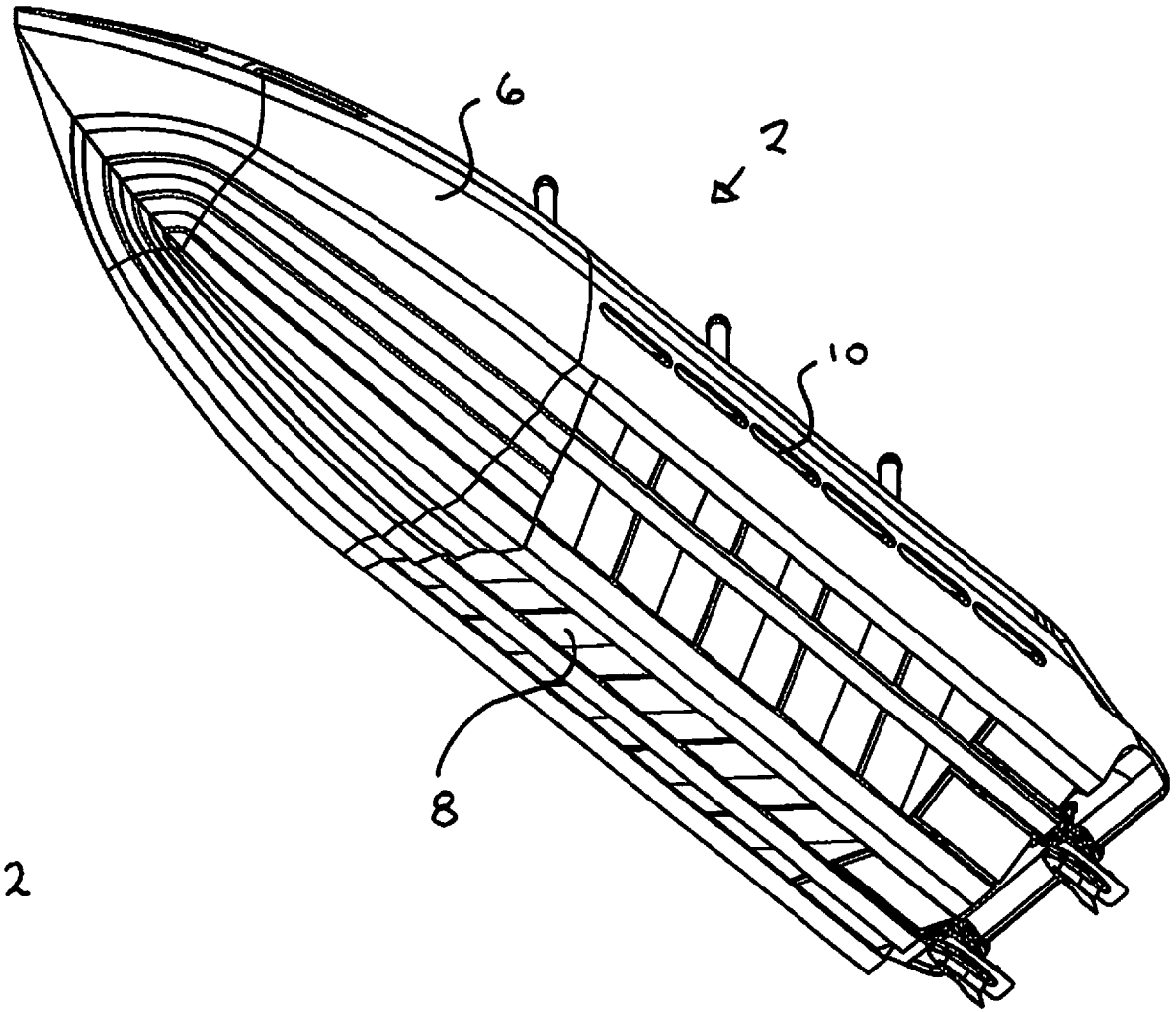
FIG. 2 is a bottom perspective view of an embodiment of the multi axis suspension vessel.
Figure 9:
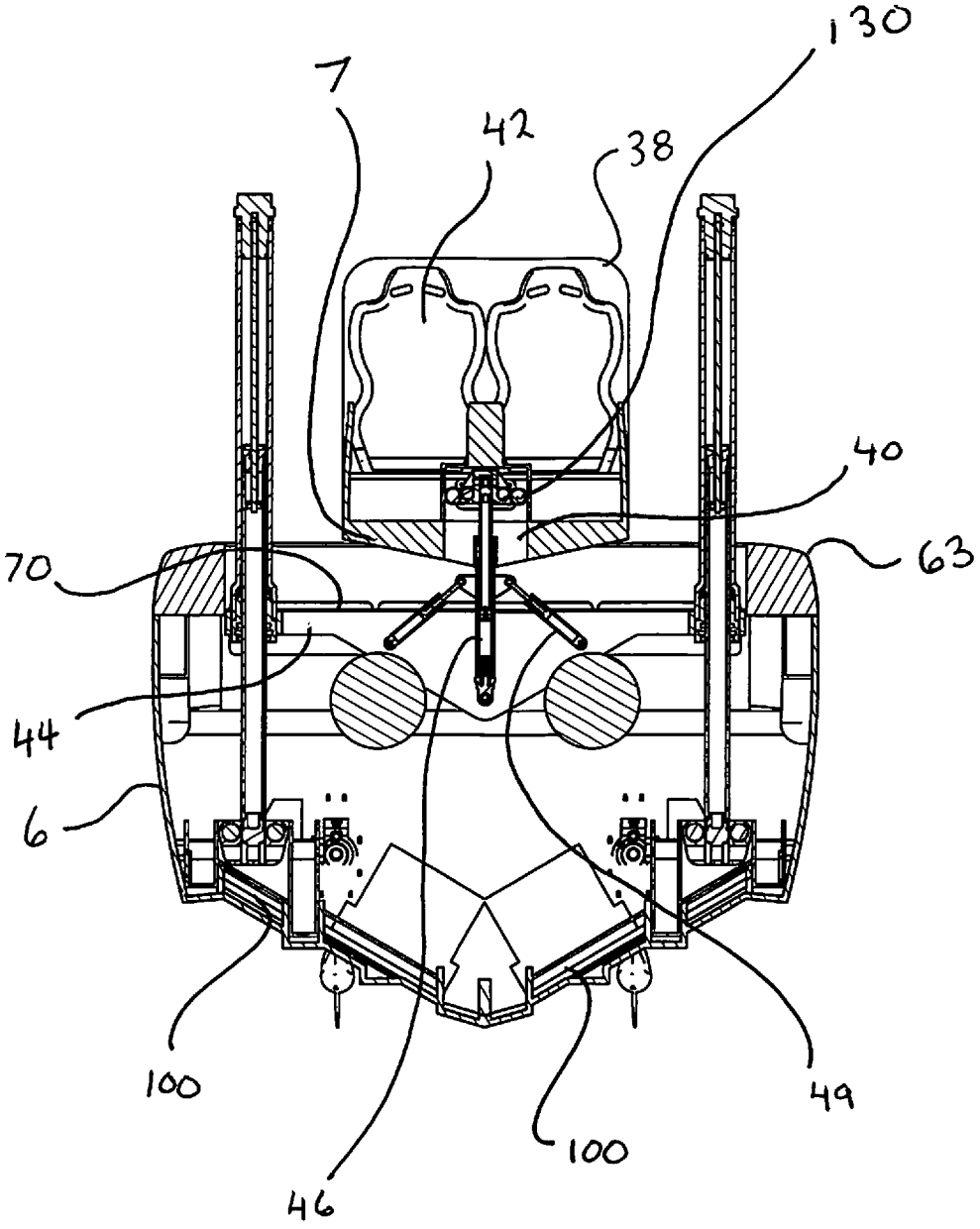
FIG. 9 is a rear cross sectional view of the multi axis suspension vessel taken through the rear one third of the vessel.

There are front vents 12 located at the front of the outer hull 6 and side vents located on the side of the outer hull. These vents have their respective ducting disposed between the outer hull 6 and inner deck hull 4. The front vents 12 have front vent ducts 100 running from the front of the vessel along the inner face of the outer hull floor atop of the louvers 8. Looking at FIGS. 1, 2 and 9 the bottom louvers 8, the side vents 10, the front vent ducts 100 are visible. As the vessel 2 moves under power, the water rushing past the bottom louvers 8 draws any water and air out from the front vents 12 through the front vent ducts 100 so as to establish a flow of air from the front vents 12 through the front vent ducts 100 and exiting out from the louvers 8 located at the bottom of the vessel 2. This acts to break the vacuum under the vessel and reduce the vessel's drag, increasing top speed, acceleration time, fuel consumption and overall efficiency.

Figure 8:
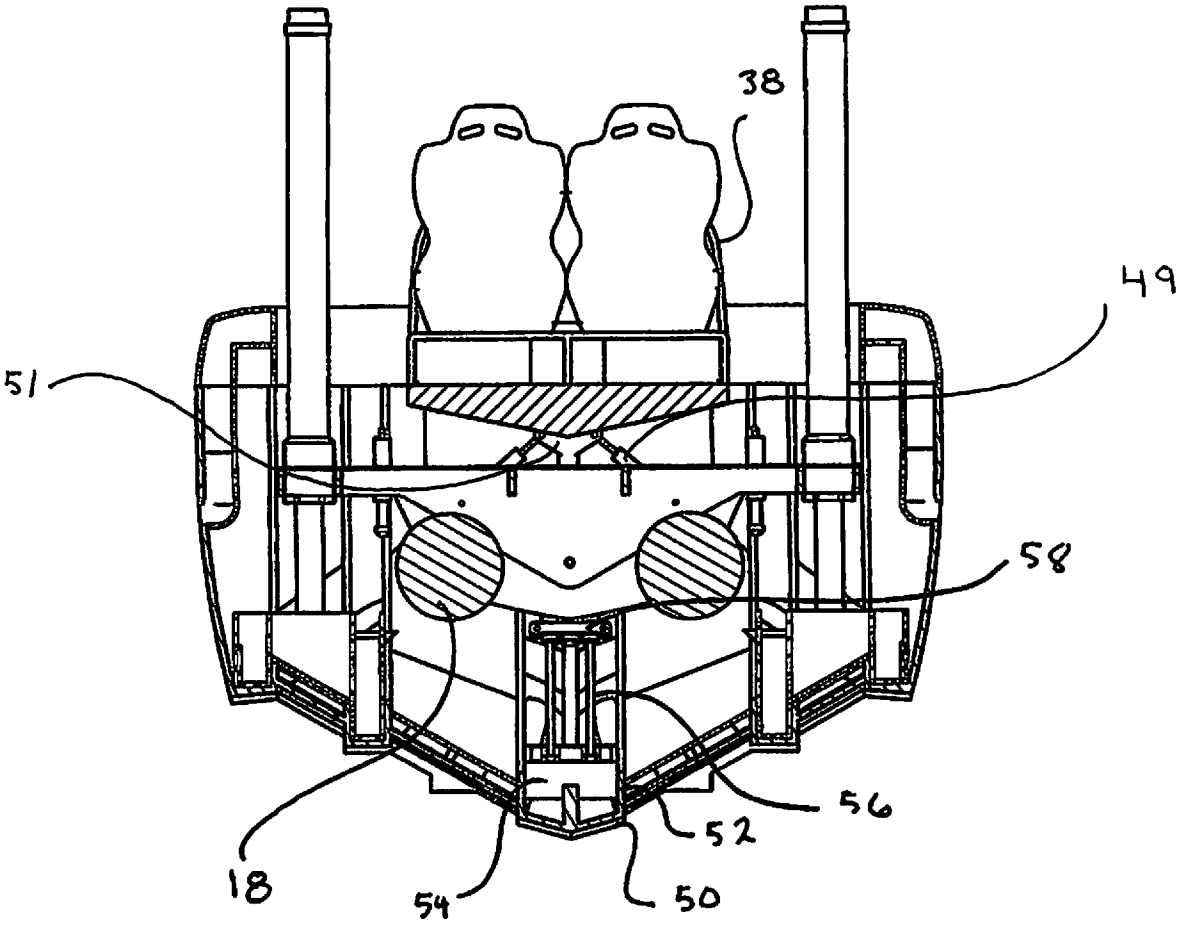
FIG. 8 is a rear cross sectional view of the multi axis suspension vessel taken in front of the transom plate.

The vessel 2 has at least one outdrive (jet or propeller) affixed to the outer hull 6 at the rear of the vessel. In the preferred embodiment there will be an operable propulsion system 14 (preferably of twin jet drives or stern drives) that extend fully or partially beyond the vessel's transom 16. The engine/s for the jet drives of the propulsion system 18 (Illustrated in FIG. 8) and the fuel tank 80 (FIG. 5) are affixed or suspended from the bottom side of the inner deck 4 such that their weight resides on the suspended, stationary inner deck 4. The engines preferably are rotary style gas but may be electric and operate at least one hydraulic pump. Regardless of their nature, they are connected to the jet drives or the stern drives of the propulsion system 14 (FIG. 3) by flexible hydraulic lines as the jet drives are hydraulically driven. The hydraulic lines are necessary as the physical orientation and distance between the hydraulic pump and the jet drives will constantly change when the vessel is moving. Flexible hydraulic oil lines accommodate the changing distance between the inner deck 4 and the outer hull 6 that occurs with the movement of the vessel on water.

Steering and braking is accomplished in two ways. First, by the movement of a pivotable nozzle on the jet drives of the propulsion system or by a propeller of a stern drive system 14 that directs the thrust fore and aft, and second by a set of inner and outer elevons, each having a right and left elevon and a front mounted elevator flap. This is discussed in detail in the US patent entitled "A Split Outer Hull Hydroplaning Vessel with a Reactive Suspension and Integrated Braking and Steering System" by the same inventor.

Figure 12:
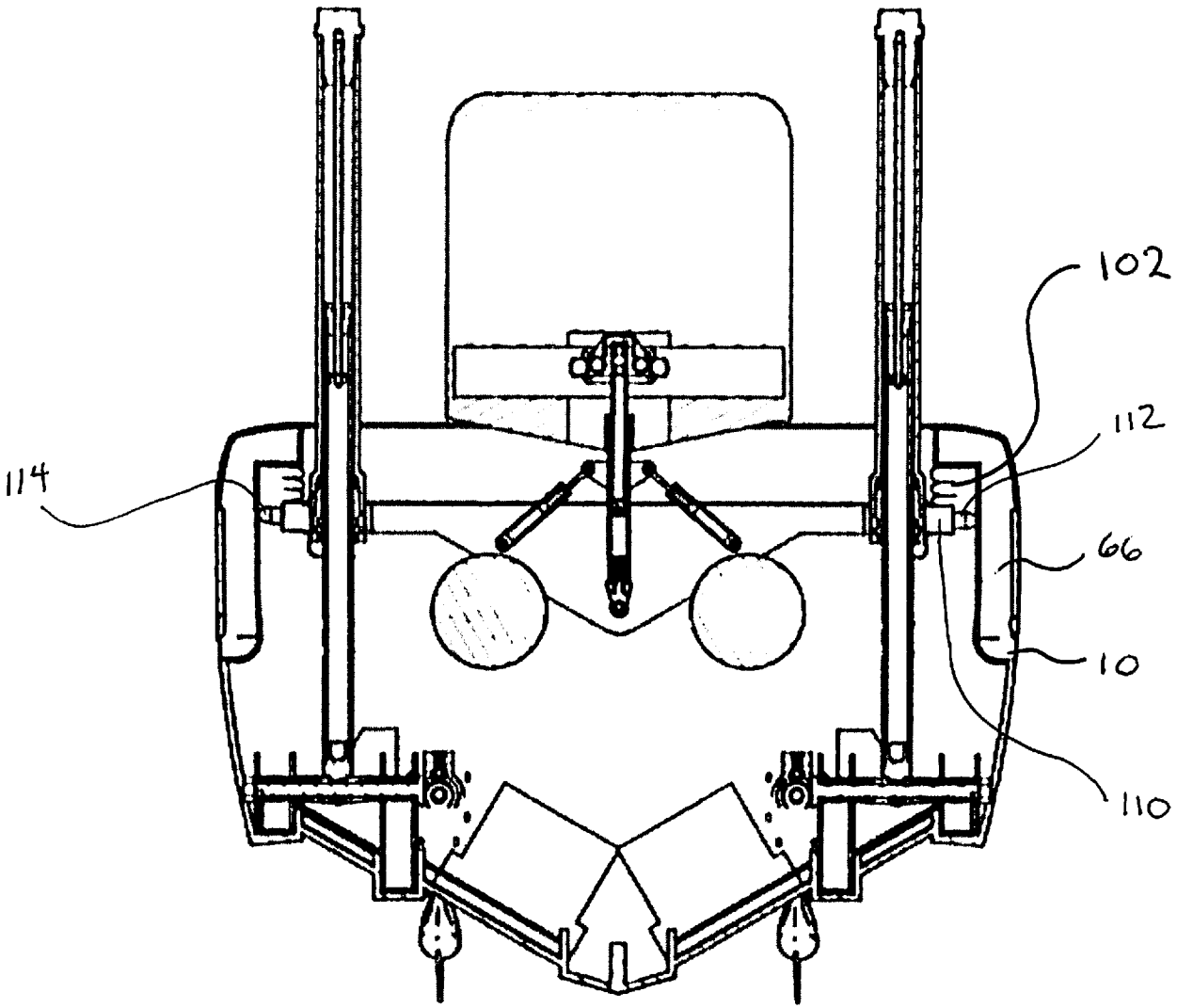
FIG. 12 is an end cross sectional view of the vessel showing the bellows seal and the fourth suspension system.

Illustrated in FIG. 12 between the inner deck 4 and the outer hull 6 is a flexible bellows seal 102 bridging across the inner deck 4 and the outer hull 6 in a continuous circumferential seal. This bellows seal 102 keeps the water out of the outer hull 6 and flexes to accommodate any change in the height of the vertical spacing between the outer hull 6 and the inner deck hull 4 as the boat moves and the suspension systems react. This bellows seal system also serves to keep passengers arms and extremities from injury or getting pinched between the inner deck 4 and the outer hull 6. The bellows seal is made of a flexible polymer fabric (pleated or planar).

Figure 7:
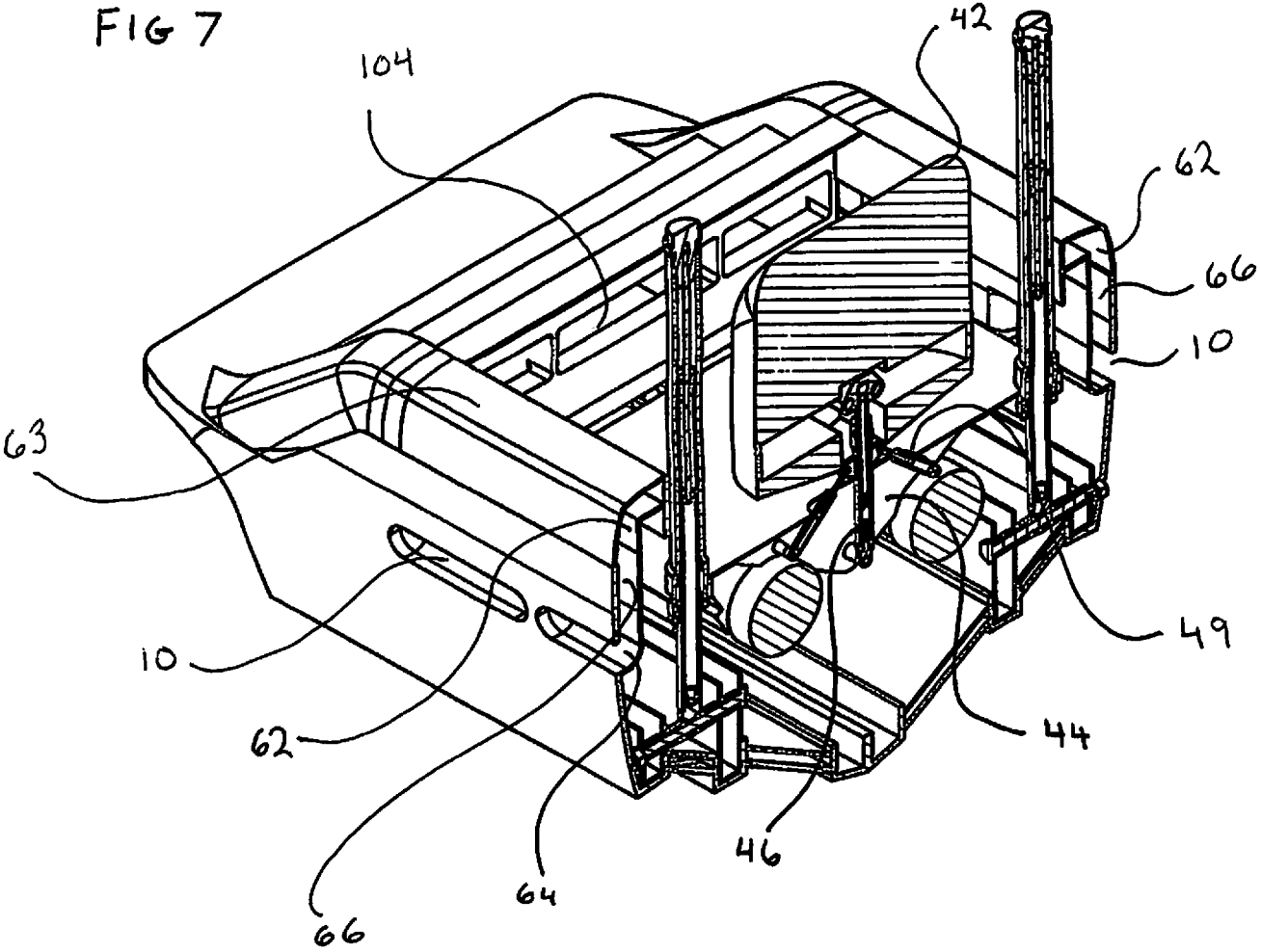
FIG. 7 is a left side perspective cross sectional view of the multi axis suspension vessel taken through the rear one third of the vessel.

Looking at FIGS. 7 and 12 it can be seen that the side vents 10 also have a side vent duct system 66 made of a lower duct section 64 that runs vertically up from the side of the outer hull 6 into the upper duct system 62 that extends through the length of the outer hull cap 63 that surrounds the inner top perimeter of the outer hull 6 and over the top of the inner deck hull 4. This upper duct system 62 runs vertically down into the cavity between the inner deck hull 4 and the outer hull 6 on the other side of the bellows seal 102 so as to allow any trapped air between the outer hull 6 and inner deck 4 to flow freely therefrom or thereto as needed when the inner deck hull 4 moves up and down with respect to the lower hull 6. There are also a set of rear vents 104 tied in to the upper duct system 62 at the rear of the vessel. It is to be noted that with a bellows seal system trapping the air the speed at which the constrained air can be exhausted is limited by the size of the side vents 10.

The vessel has four separate suspension systems to compensate for movement experienced by the outer hull 6. Three of these suspension systems operate primarily in the vertical plane and one functions primarily in the horizontal plane. These systems may be utilized alone however it is the synergistic effect between these four suspension systems that allow for overlap in the cushioning and motion reduction features that they offer. It is also to be noted that this multi axis suspension system also keeps the outer hull in contact with the water when the mass of the vessel rises above the vessel's waterline. This is because the suspension system reacts in both directions along its linear axis. With the inner deck having a greater mass than that of the outer hull (because the inner deck has the added mass of the passengers, cargo, fuel tank/s, seats and engine/s) when the vessel rises above the waterline, the suspension systems will push the lighter mass outer hull 6 downward keeping it in contact with the water. This enhances steering and vessel control.

All the suspension systems utilize forms of shock absorbers, the technology of which is well known in the industry. They may be hydraulic, pneumatic, mechanical (springs) or any combination thereof. Each of the shock absorbers used in the suspension systems herein have a form of outer housing (such as a pressure tube casing) that contain the working components of the shock absorber and an extendable ram (or arm) that protrudes therefrom and extends or retracts from the housing based on the compressive forces it experiences between the housing and the ram vs the compressive resistant forces generated by the components contained therein the housing. The housing and the ram are connected to the separable elements of the inner deck and the outer hull.

Figure 5:
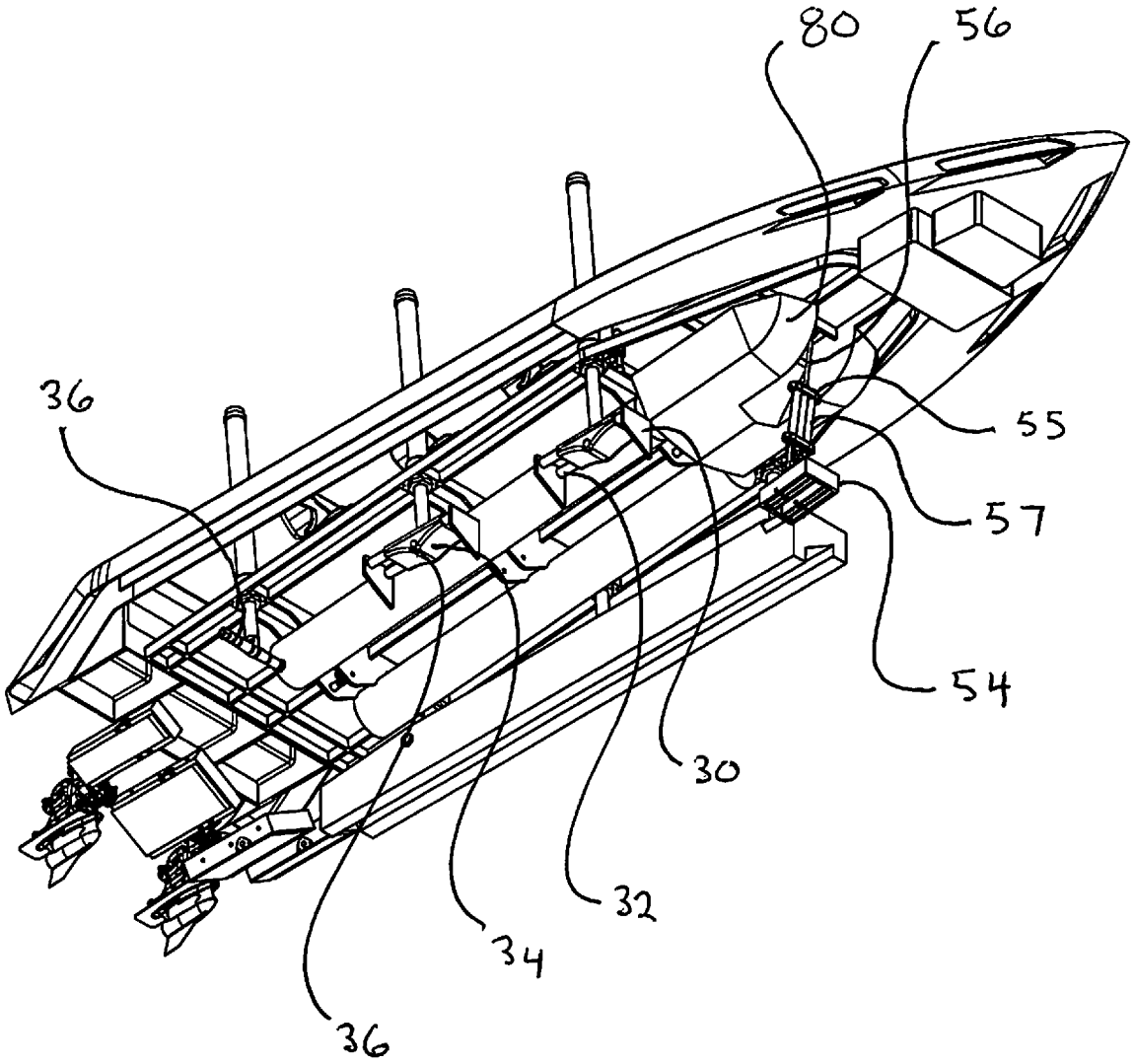
FIG. 5 is a left bottom perspective view of the inner deck of the multi axis suspension vessel.
Figure 6:
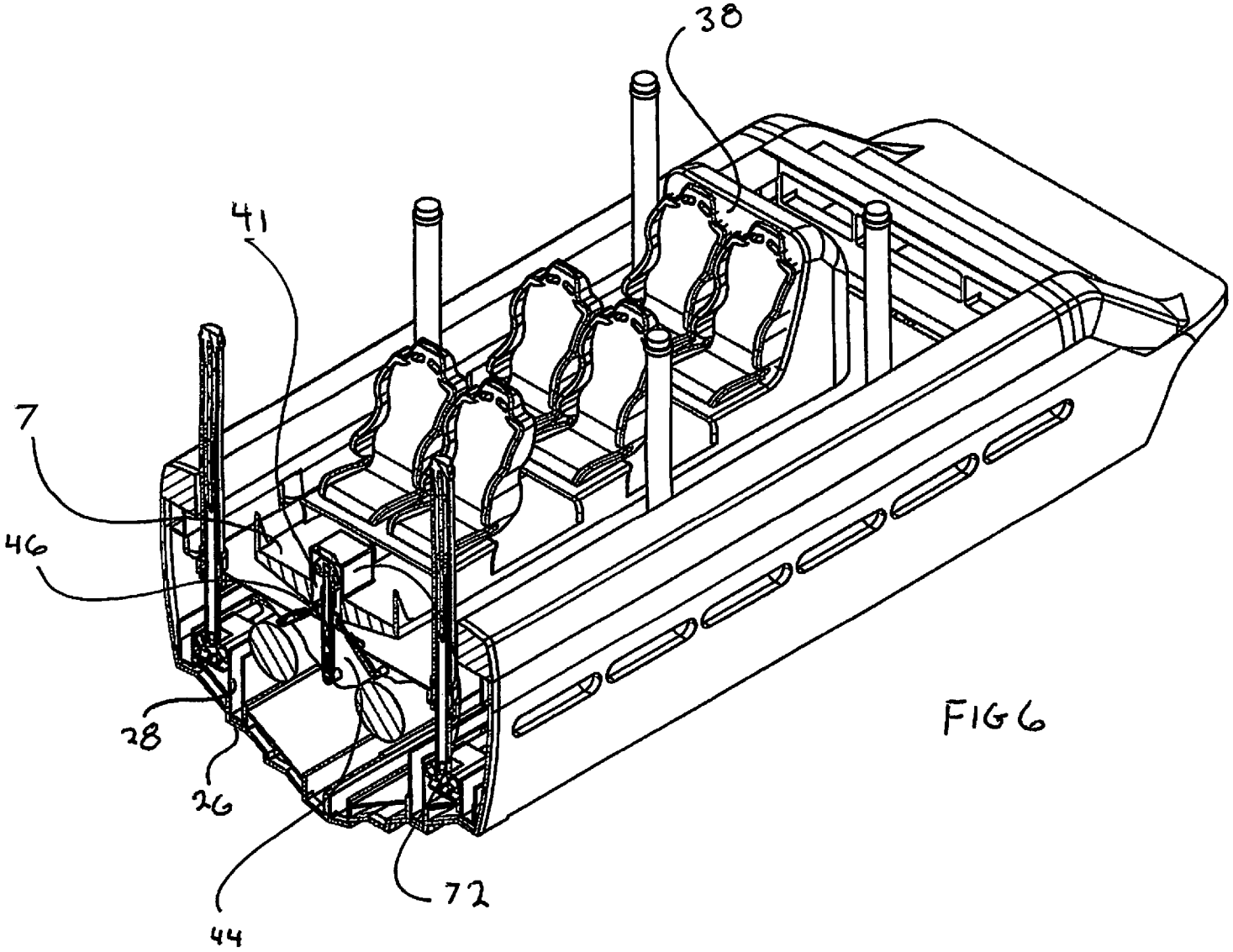
FIG. 6 is a right side perspective cross sectional view of the multi axis suspension vessel taken through the front one third of the vessel.

The first suspension system 1 is the inner hull vertical suspension system, best seen in FIGS. 4, 5 and 6. It has at least two sets of two (or more) vertical shock absorbers 20 (hydraulic or pneumatic) that extend above the inner deck. Each set resides on different sides of the vessel in a mirror image about the vessel's linear axis. Each shock absorber has their pressure tube casing 22 rigidly mounted to the floor 70 of the inner deck 4 and their extendable ram 24 affixed to the outer hull 6 in a novel arrangement that varies between the shock absorbers 20. Running along the top face of the outer hull 6, are formed troughs 26 that lie in mirror image configurations of each other about the linear axis of the vessel. In each of these troughs are affixed two parallel linear, U shaped, structural metal members 28 that form a linear channel that resides directly below at least the first two of the shock absorbers 20. In these two channels formed between the side walls of the two structural members 28 are parallel braces 30 affixed across said troughs that support a pair of parallel rods 32. There is a bracket 34 slidebly mounted on these rods for limited fore and aft movement. In FIG. 5 there is a pin 36 that traverses across the bracket 34 that attaches to the rod end of the extendable ram 24. This allows for angular vertical alignment of the vertical shock absorbers 20 beyond the allowed movement of the bracket 34.

There are at least two of these sliding bracket arrangements, one per side of the vessel that are connected to the first and second shock absorbers 20 of each side. The rear shock absorber does not have this sliding ability as its rod end is affixed to another pin 36 connected between the side walls of the structural members 28. This rear pinning and front sliding vertical shock absorber arrangement allows the inner deck 4 to remain horizontal as the outer hull 6 vertically gyrates beneath it.

It is known that when this suspension system is used in a smaller length vessel, the number of vertical shock absorbers may only be four with the elimination of the middle shock absorber as disclosed above.

Figure 11:
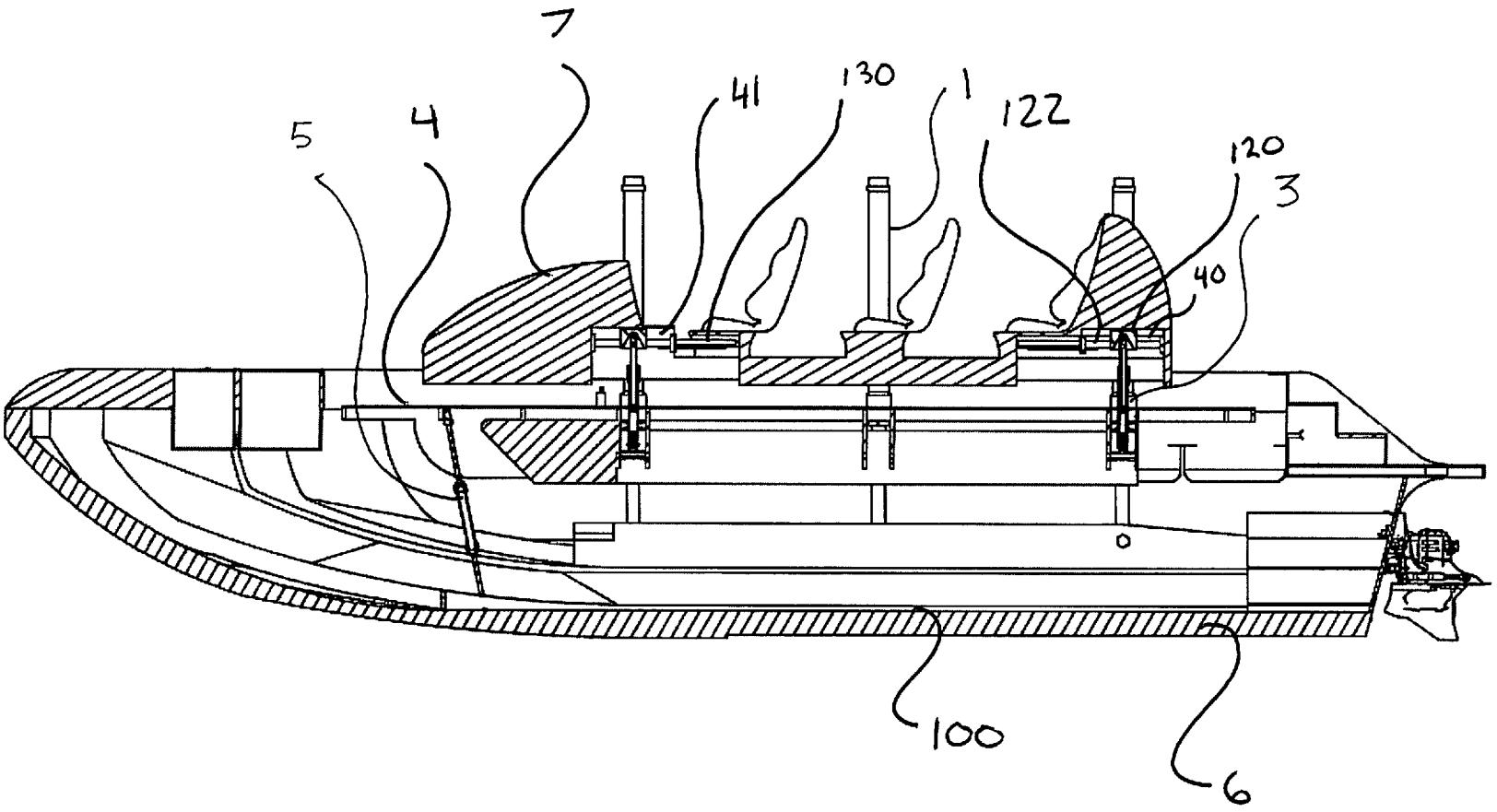
FIG. 11 is a side cross sectional view of the vessel showing three of the suspension systems.

The second suspension system 3 (FIG. 11) is the inner deck sliding angular suspension system and it resides between the inner deck hull 4 and the passenger carriage 7. It maintains the passenger carriage 7 suspended above the inner deck hull which has a pair of identical front and rear inner deck sliding angular shock systems that are mounted between the inner deck 4 and the passenger seat assembly 38. (FIGS. 6-9) Each shock system has three shock absorbing units. One is a central vertical shock absorber 46 and the other two are angular pneumatic actuators 49. The central vertical shock absorber 46 is attached at its bottom end to the inner hull deck 4 and at its top end into a sliding mechanism built into the passenger carriage. In this way it allows the carriage to slide fore and aft up to an approximate two feet as a safety feature to increase the time of deceleration in the event of a sudden and complete stop.

A pair of substantially similar horizontal support plates 44 are affixed to and reside across the bottom of inner deck 4 perpendicular to the linear axis of the inner deck 4. These support plates 44 are located at the front of the inner deck 4 (FIG. 6) and rear of the inner deck 4. (FIG. 7) They serve to stiffen and give support to the floor 70 of the inner deck 4 as well as serve as the bottom mounting locations for the vertical shock absorber 46 and the other two are angular pneumatic actuators 49.

A rear mounting bracket 40 is affixed onto the rear of the passenger carriage 7 by the last seat 42 of the seat assembly 38. A front mounting bracket 41 is affixed at the front end of the passenger carriage 7, (FIGS. 6-9) ahead of the most forward seats but behind the bow of the boat and front end of the inner deck 4. In each of the mounting brackets 40 and 41 there are parallel, linear, cylindrical members 122 running fore and aft around which is mounted a sliding block 120 having accommodating parallel through bores.

The central vertical shock absorber 46 is pivotally mounted at its bottom to the support plate 44 and pivotally mounted at its top extendable ram to the sliding block 120 in its respective mounting bracket 40 or 41. There are horizontal shock absorbers 130 also mounted with one of their ends onto the sliding blocks 120 and with their extendable rams affixed to one end of the mounting bracket 40. These serve to slow the speed of deceleration of the carriage by slowing the moving passenger carriage off of the inner deck hull (which will be stationary) through the central vertical shock absorber 46.

Between the mounting brackets 40 and 41 and the support plates 44 are actuator plates 51 that are mounted at the bottom of the passenger carriage 7. Between each support plate 44 and mounting bracket 40 (FIG. 9) lie the centrally located, vertical shock absorber 46 and the two angular pneumatic actuators 49.

The left and right side pneumatic actuators 49 are pivotally mounted on their bottoms to the support plate 44 and pivotally mounted at their tops to the actuator plate 51 which is between the mounting plate 40 and the support plate 44. The left and right side pneumatic actuators 49 are disposed at mirror image acute angles from the vertical, taken across the vertical axis of the central shock absorber 46. This arrangement prevents axial motion of the passenger seat assembly 38 on the passenger carriage 7 (such as the side loads of waves hitting the side of the vessel and causing it to surge or roll from left to right.). The left and right side pneumatic actuators 49 may also be employed to work with a gyro system to maintain the horizontal position of the passenger seat assembly 38 with respect to the position of the outer hull 6 and inner deck hull 4. The upper pivotal connections of the shock absorbing trio to the passenger carriage and the lower pivotal connections of the shock absorbing trio to the support plate 44 of the inner deck hull adjust the side to side angular and the up and down orientation of the passenger carriage 7 with respect to the inner deck 4 from the front and rear of the inner deck 4.

This shock absorbing trio along with the horizontal shock absorber, like all of the shock absorbers on the vessel, may substitute hydraulic shock absorbers and any one may have a spring coil over the assembly as well.

The third suspension system 5 (FIG. 11) is the fore and aft suspension system and it resides at the front of the vessel. (See FIGS. 5 and 8) It is to compensate for the vertical discrepancies experienced between the front and rear of the vessel 2. Because the bow of the vessel arcs upward, it would be possible in rough conditions for the front of the inner deck hull 4 to strike the bottom of the outer hull 6 without this suspension system. The suspension unit is comprised of three, identical, minor shock absorbers 57 that are assembled into a parallel shock assembly 56, wherein the three shock absorbers are connected at their distal and proximal ends by a pair of assembly plates 55. The outer two shock absorbers are oriented such that their extendable rams face down and are pivotally connected to the outer hull 6 and the central shock absorber is oriented such that its extendable ram faces up and is connected to the inner deck hull 4. The parallel shock assembly 56 is mounted between the upper deck hull 4 and the outer hull 6 and located at the front of the vessel. It is also disposed at a forward enclosed acute angle with respect to the vertical.

Similar to the first suspension system, there is a trough 50, centrally formed in the outer hull 6, in which is affixed a linear, structural metal U shaped member 52 preferably bonded or rigidly affixed to the bottom of the outer hull 6 along the vessel's linear midline. In this U shaped member 52 at the front of the vessel is a shock mounting box 54 to which the extendable rams of the two outer shock absorbers, which are extending through the lowermost of the two assembly plates, are pivotally connected, anchoring the bottom of the third suspension system to the outer hull 6. The remaining inner shock absorber has its extendable ram extending through the uppermost of the assembly plates where it is pivotally affixed to a mount 58 on the underside of the inner deck hull 4. It is because this third suspension system is used to compensate for the vertical discrepancies experienced between the front and rear of the vessel, as well as fore and aft movement differences between the outer hull 6 and the inner deck hull 4, that the front third suspension unit 56 is disposed at an acute angle with respect to the vertical. The upper portion of the suspension unit 56 angles toward the front of the vessel and the lower portion of the suspension unit 56 angles toward the rear of the vessel.

Using multiple shock absorbers accomplishes three things. It offers redundancy in the event of a single shock failure, and since the shock absorbers in the suspension unit 56 are coupled in a side by side parallel configuration; it offers a horizontal line of contact rather than a single point contact with the inner deck 4 and the shock mounting boxes 54; and lastly it doubles the compressible travel of the entire parallel shock assembly 56 as the shock absorbers' rams extend out in opposite directions. This fourth suspension system helps distribute the fore and aft elevation discrepancies of the inner deck 4 between the two shock absorbers so as to prevent the inner deck from striking the inside of the outer hull 6.

The fourth suspension system is the outer hull horizontal suspension system seen in FIG. 12. It is a series of short horizontal shock absorbers 110 that are under a stress preload and reside along the gunnels of the vessel between the inner deck 4 and the outer hull 6. Their extendable rams expand and retract with a change in the gap between the two hulls. The distal end of their compressible rams 112 always contact the upper side of the outer hull 6 while the proximal end of these horizontal shock absorbers 110 remains anchored to the inner deck hull 4. Since the two hulls also move fore and aft with respect to each other, there are roller balls 114 affixed on the distal ends of the rams. This allows the two hulls to slide by each other while all of the horizontal shock absorbers 110 remain in contact with the outer hull 6. This fourth suspension system serves to minimize any "flutter" transmitted to the inner deck 4 and to strengthen the profile of the outer hull 6.

The synergistic effect of the four independent suspension systems is to allow the passengers and cargo to remain comfortable on an inner deck that has a minimal of vertical, axial and horizontal movement with respect to what the outer hull 6 of the boat is experiencing.

While certain features and aspects have been described with respect to exemplary embodiments, one skilled in the art will recognize that numerous modifications are possible. For example, the methods and processes described herein with respect to any gyroscopic control system may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A marine vessel with a multi axis suspension system, comprising:

an outer hull, said outer hull having a first mass;

an inner deck hull having a floor, said inner deck hull having a second mass;

a passenger carriage suspended above said inner deck hull by suspension system;

a vertical suspension system extending above said inner deck hull, wherein said vertical suspension system is operatively connected between said inner deck hull and said outer hull so as to hold said inner deck hull in a spaced configuration above said outer hull so as to form a double hulled vessel; and wherein said second mass is greater than said first mass.

2. The marine vessel with a multi axis suspension system of claim 1 further comprising:

a motor of a propulsion system affixed to said inner deck hull; and a fuel tank affixed to said inner deck hull.

3. The marine vessel with a multi axis suspension system of claim 1 further comprising:

at least one front vent formed through said outer hull;

at least one side vent formed through said outer hull;

at least one bottom louver formed through said lower hull, at least one front vent duct connected between said front vent and said bottom louver; and a bellows seal, said bellows seal affixed in a continuous ring between said outer hull and said inner deck hull.

4. The marine vessel with a multi axis suspension system of claim 1, said vertical suspension system further comprises:

a first set of at least three vertical shock absorbers;

a second set of at least three vertical shock absorbers, said second set arranged as a mirror image of said first set about a linear axis of said vessel;

wherein all of said vertical shock absorbers have an outer housing from which protrudes an extendable ram, said outer housing affixed to said inner deck hull and extending upward from said floor of said inner deck, and said extendable ram affixed to said outer hull.

5. The marine vessel with a multi axis suspension system of claim 4, wherein said second set of at least three vertical shock absorbers are arranged on said inner deck hull as a mirror image to said first set of at least three vertical shock absorbers said mirror image taken about a linear axis of said vessel.

6. The marine vessel with a multi axis suspension system of claim 5 further comprising:

a pair of two troughs formed along a top face of said outer hull below said floor of said inner deck hull, said pair of two troughs arranged as mirror images of each other about said linear axis of said vessel;

at least four U shaped, structural members, one of said structural members affixed in each of said troughs so as to form a first channel below said first set of at least three vertical shock absorbers and a second channel said second set of at least three vertical shock absorbers;

at least four pair of parallel braces with at least two pair formed across said first channel and with at least two pair formed across said second channel;

at least four pair of parallel rods rigidly mounted between each of said pair of parallel braces;

a bracket slidebly mounted on each pair of parallel rods; and wherein said extendable ram of said shock absorbers are attached to said brackets so as to allow angular vertical movement of said vertical shock absorbers.

7. The marine vessel with a multi axis suspension system of claim 6 further comprising a pin extending across said bracket and through an orifice in said extendable ram.

8. The marine vessel with a multi axis suspension system of claim 7 further comprising:

a motor for a propulsion system affixed to said inner deck hull; and a fuel tank affixed to said inner deck hull.

9. The marine vessel with a multi axis suspension system of claim 8 further comprising:

at least one front vent formed through said outer hull;

at least one side vent formed through said outer hull;

at least one bottom louver formed through said lower hull;

at least one front vent duct connected between said front vent and said bottom louver; and a bellows seal, said bellows seal continually affixed in a ring between said inner deck hull and said outer hull.

* * * * *